US007690422B2

(12) United States Patent
Swietlik et al.

(10) Patent No.: US 7,690,422 B2
(45) Date of Patent: Apr. 6, 2010

(54) DRILL-STRING CONNECTOR

(75) Inventors: George Swietlik, Lowestoft (GB); Robert Large, Lowestoft (GB)

(73) Assignee: Pilot Drilling Control Limited, Lowestoft (GB)

( * ) Notice: Subject to any disclaimer, the term of this patent is extended or adjusted under 35 U.S.C. 154(b) by 63 days.

(21) Appl. No.: 11/703,915

(22) Filed: Feb. 8, 2007

(65) Prior Publication Data

US 2007/0181346 A1 Aug. 9, 2007

(30) Foreign Application Priority Data

Feb. 8, 2006 (GB) ..... 0602565.4

(51) Int. Cl.
*E21B 19/00* (2006.01)
*E21B 21/10* (2006.01)

(52) U.S. Cl. ..... 166/90.1; 166/85.1

(58) Field of Classification Search ..... 166/90.1, 166/85.1

See application file for complete search history.

(56) References Cited

U.S. PATENT DOCUMENTS

| | | | | |
|---|---|---|---|---|
| 2,748,871 | A | 6/1956 | Brown | |
| 3,120,272 | A | 2/1964 | Cochran | |
| 4,364,407 | A | 12/1982 | Hilliard | |
| 4,625,755 | A | 12/1986 | Reddoch | |
| 4,658,905 | A | 4/1987 | Burge | |
| 4,836,287 | A | 6/1989 | Eric et al. | |
| 4,997,042 | A * | 3/1991 | Jordan et al. | 166/379 |
| 5,191,939 | A | 3/1993 | Stokley | |
| 5,501,280 | A | 3/1996 | Brisco | |
| 5,584,343 | A | 12/1996 | Coone | |
| 5,682,952 | A | 11/1997 | Stokley | |
| 5,735,348 | A | 4/1998 | Hawkins, III | |
| 5,890,538 | A | 4/1999 | Beirute et al. | |
| 5,918,673 | A | 7/1999 | Hawkins et al. | |
| 5,971,079 | A | 10/1999 | Mullins | |
| 6,173,777 | B1 | 1/2001 | Mullins | |
| 6,279,654 | B1 | 8/2001 | Mosing et al. | |
| 6,390,190 | B2 | 5/2002 | Mullins | |
| 6,415,862 | B1 | 7/2002 | Mullins | |
| 6,460,620 | B1 | 10/2002 | LaFleur | |
| 6,571,875 | B2 | 6/2003 | Bissonnette et al. | |
| 6,571,876 | B2 | 6/2003 | Szarka | |

(Continued)

FOREIGN PATENT DOCUMENTS

EP 0 162 000 A1 11/1985

(Continued)

OTHER PUBLICATIONS

Search Report for UK Patent Application No. GB0802406.9, dated Apr. 29, 2008 (1 page).

(Continued)

*Primary Examiner*—Giovanna C Wright
(74) *Attorney, Agent, or Firm*—Osha • Liang LLP

(57) ABSTRACT

A connector (10) which provides a fluid tight connection between a fluid supply and a drill-string (4), the connector (10) comprising a piston-rod (20) and a cylinder (15), the piston-rod (20) having a seal at or towards its free end which is adapted to sealingly engage the drill-string (4) when the piston-rod (20) is at least partially extended from the cylinder (15).

24 Claims, 4 Drawing Sheets

U.S. PATENT DOCUMENTS

| | | | | |
|---|---|---|---|---|
| 6,604,578 | B2 | 8/2003 | Mullins | |
| 6,666,270 | B2 | 12/2003 | Vann | |
| 6,675,889 | B1 * | 1/2004 | Mullins et al. | 166/90.1 |
| 6,715,542 | B2 | 4/2004 | Mullins | |
| 6,722,425 | B2 * | 4/2004 | Mullins | 166/90.1 |
| 6,732,804 | B2 | 5/2004 | Hosie et al. | |
| 6,779,599 | B2 | 8/2004 | Mullins et al. | |
| 6,883,605 | B2 | 4/2005 | Arceneaux et al. | |
| 7,028,769 | B2 | 4/2006 | Mullins | |
| 7,096,948 | B2 | 8/2006 | Mosing et al. | |
| 2002/0100501 | A1 | 8/2002 | Hollister et al. | |
| 2002/0129934 | A1 | 9/2002 | Mullins et al. | |
| 2003/0221519 | A1 | 12/2003 | Haugen | |
| 2004/0000405 | A1 | 1/2004 | Fournier et al. | |
| 2005/0000695 | A1 | 1/2005 | LaFleur | |
| 2005/0173154 | A1 | 8/2005 | Lesko | |
| 2005/0236154 | A1 | 10/2005 | Tudor et al. | |
| 2005/0274528 | A1 | 12/2005 | Hiron et al. | |
| 2007/0023190 | A1 | 2/2007 | Hall et al. | |
| 2008/0059073 | A1 | 3/2008 | Giroux et al. | |

FOREIGN PATENT DOCUMENTS

| | | | |
|---|---|---|---|
| EP | 0692345 | A1 | 1/1996 |
| EP | 1 260 671 | B1 | 9/2004 |
| EP | 1632640 | | 3/2006 |
| GB | 1 338 295 | | 11/1973 |
| GB | 1 493 717 | | 11/1977 |
| GB | 2 156 402 | A | 10/1985 |
| GB | 2340856 | | 3/2000 |
| GB | 2394973 | | 5/2004 |
| GB | 2 399 112 | A | 9/2004 |
| GB | 2422162 | | 7/2006 |
| GB | 2435059 | A | 8/2007 |
| GB | 2439427 | A | 12/2007 |
| WO | WO93/07358 | | 4/1993 |
| WO | WO 00/19060 | | 4/2000 |
| WO | WO00/61909 | | 10/2000 |
| WO | WO2004/079153 | | 9/2004 |
| WO | 2005090740 | | 9/2005 |
| WO | 2007127737 | | 11/2007 |

OTHER PUBLICATIONS

Search Report for UK Patent Application No. GB0802407.7, dated Apr. 30, 2008 (1 page).

Search Report for UK Patent Application No. GB0805299.5, dated May 21, 2008 (2 pages).

Search Report for UK Patent Application No. GB0805299.5, dated Jul. 28, 2008 (2 pages).

International Search Report for Patent Application No. PCT/GB2009/000349, dated Jun. 24, 2009 (15 pages).

International Search Report for Patent Application No. PCT/GB2009/000339, dated Jul. 8, 2009 (13 pages).

International Search Report for Patent Application No. PCT/GB2009/000338, dated Jul. 9, 2009 (6 pages).

International Search Report for Patent Application No. PCT/GB2009/000344, dated Jul. 9, 2009 (6 pages).

Mechanical English translation of European Patent Application No. EP1632640, published Mar. 8, 2006 (6 pages).

International Search Report for Patent Application No. PCT/GB2009/000344, dated Oct. 6, 2009 (18 pages).

International Search Report for Patent Application No. PCT/GB2009/000338, dated Oct. 13, 2009 (19 pages).

Canadian Association of Oilwell Drilling Contractors (CAODC), "SI Drilling Manual 1st Edition", Gulf Publishing Company, Section B20, p. 1.

* cited by examiner

DRILL-STRING CONNECTOR

This invention relates to a connector which establishes a fluid tight connection to a drill-string and preferably establishes a fluid tight connection between a drill-string and a top-drive.

BACKGROUND

It is known in the oil and gas industry to use a top drive motor and a drill-string to drill wells. It is the top drive motor that provides the torque to rotate the drill-string, which in turn rotates the drill bit at the bottom of the well. The drill-string itself consists of a series of hollow pipes, typically 30 ft (9.14 m) in length, and these are attached to each other via a threaded connection. The top drive is also attached to the drill-string via a threaded connection.

During the drilling process, drilling-mud is pumped through the connection between the top drive and the drill-string. This drilling-mud travels through the drill-string and ensures sufficient lubrication, cooling and the removal of cuttings. It is often necessary to remove the drill-string from the well (to replace the drill bit for example) and under such circumstances drilling-mud is pumped through the drill-string to displace and support the retreating drill-string and maintain hydraulic balance in the well bore. This ensures that a vacuum is not created and that the force required to remove the drill-string is minimised, allowing the removal to occur more quickly. In a conventional arrangement, the drilling-mud is pumped through the same connection, between the top drive and drill-string, as used when drilling.

When removing a drill-string from a well (which in the industry is known as tripping-out), successive sections of the drill-string have to be disconnected from the remaining sections of the drill-string. Furthermore, the section being removed also has to be disconnected from the top drive. A new connection is then established between the top drive and the remaining sections of the drill-string. However, making and breaking these threaded connections is-very time consuming and slows down the process of removing a drill-string from a well. This has a serious impact on the productivity of the well.

Previous attempts have been made at speeding up the process of tripping-out. GB2156402A discloses methods for controlling the rate of withdrawal and the drilling-mud pressure to maximise the tripping-out speed. However, the time taken to connect and disconnect each section of the drill-string to the top drive is not addressed. Other attempts include removing several sections at a time, as discussed in GB2156402A. However, this approach is limited by the height of the derrick holding the top drive.

STATEMENTS OF INVENTION

According to the present invention, there is provided a connector which provides a fluid tight connection between a fluid supply and a pipe, the connector comprising a body portion and an extendable seal portion, the seal portion comprising a seal which is adapted to sealingly engage the pipe, the connector also comprising a valve being arranged such that it is opened by the pressure of fluid from the fluid supply when the seal portion is engaged with the pipe.

The seal may comprise a tapered bung, which may be forced into the open end of the pipe, when the seal portion is at least partially extended from the body portion.

The seal portion may comprise a piston-rod having a cap and a shaft which are joined together, the shaft being slidably mounted within the cylinder. The cap and part of the shaft may be located inside the cylinder.

The connector may further comprise a piston, the piston being slidably mounted on the shaft within the body portion. The body portion may comprise a cylinder. The piston and cap may divide the cylinder into two chambers: a first-chamber and a second-chamber. The first chamber may contain, air whilst the second chamber may contain drilling mud.

In one embodiment, the piston-rod may have a central flow passage which provides a flow communication path between the second-chamber and the pipe. Furthermore, a flow communication path from the inside of the hollow shaft to the cylinder may be provided by a hole in the piston-rod. The inside of the hollow shaft is not in flow communication with the cylinder when the piston covers the hole in the piston-rod.

The pipe may be a drill-string.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION OF THE PREFERRED EMBODIMENT

Figure 1:
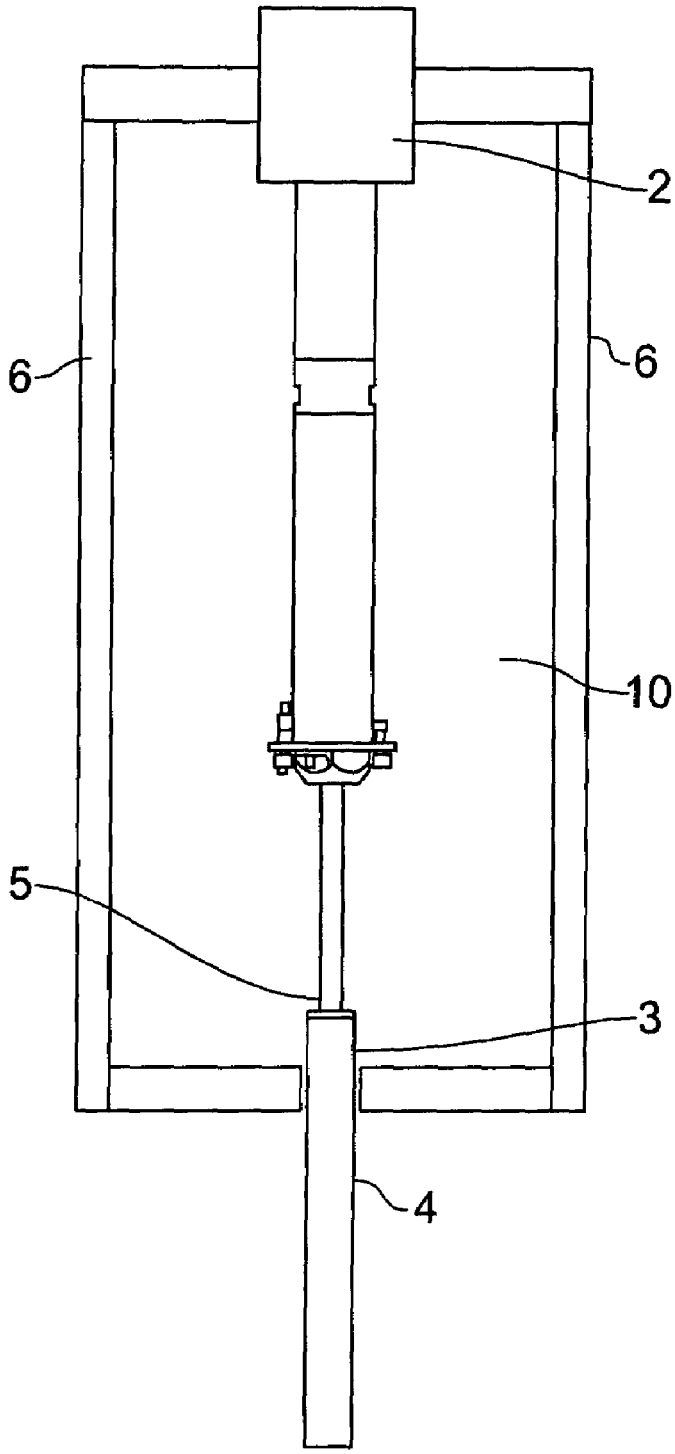
FIG. 1 is a schematic of the connector and shows the connector in position between the top drive and the drill-string.

With reference to FIG. 1, a drill-string 4 is removed from a well by raising a top drive 2. The drill-string 4 is connected to the top drive 2 in two ways. Firstly, elevators 6 clamp around the drill-string 4, and these transmit the force required to raise (or lower) the drill-string 4. Secondly, the top-most section 3 of the drill-string 4 is provided with a female thread which engages a male threaded connector 5 on the top drive 2 to provide a connection to allow drilling-mud to be pumped into the drill-string 4. Once a section of the drill-string 4 is removed from the well it must then be disconnected from the rest of the drill-string 4 and the top drive 2 before it can be taken away (or racked into the derrick (not shown)). The remaining sections of the drill-string 4 are held in place by conventional slips on a rotary table (not shown). In conventional arrangements, the join between the top drive 2 and the drill-string 4 is a threaded connection. Making and breaking this connection is time consuming, particularly when removing an entire drill-string 4. The present invention relates to an alternative means for establishing this connection.

Figure 2:
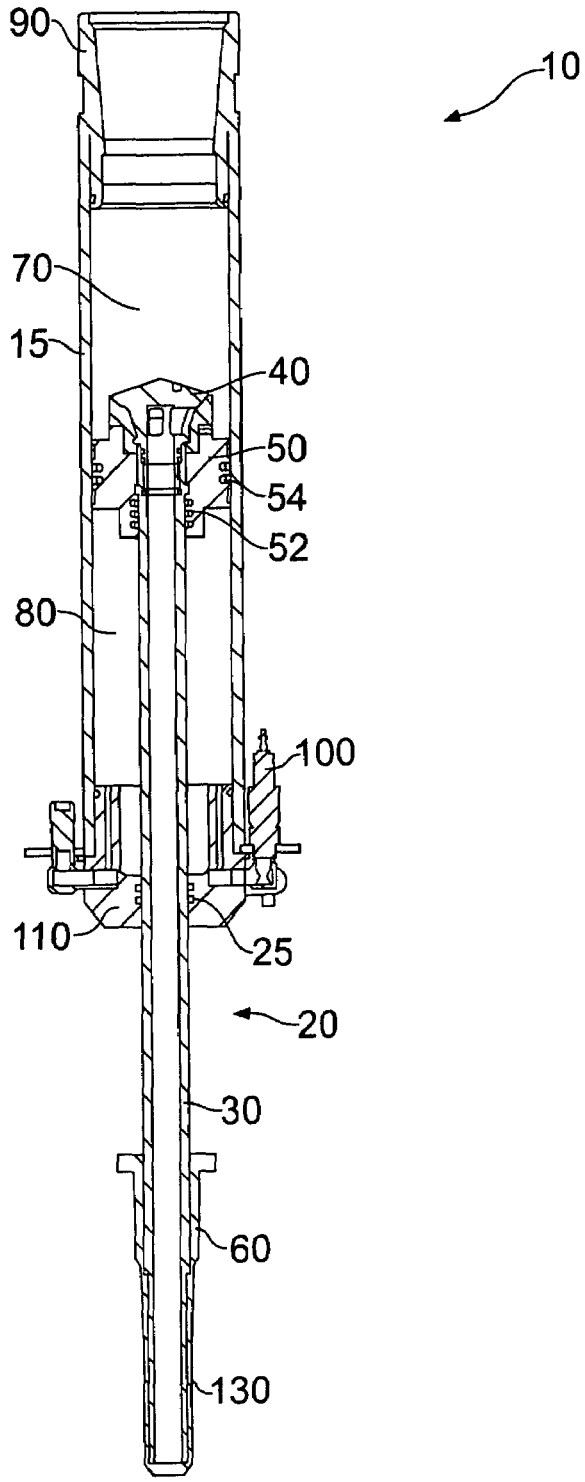
FIG. 2 is a sectional side projection of the connector and shows the connector prior to engagement with the drill-string.

With reference to FIG. 2, a connector 10, according to the present invention, comprises a cylinder 15 and a piston-rod 20, the piston-rod 20 being slidably engaged in the cylinder 15. The piston-rod 20 further comprises a hollow shaft 30, on which is mounted a cap 40, the shaft 30 being slidably engaged in the cylinder 15 such that a first end of the shaft 30 protrudes outside the cylinder 15 and a second end is within the cylinder 15. The cap 40 is mounted on a second end of the shaft 30, whilst on a first end of the shaft 30 there is located a bung 60 and seals 130. The bung 60 is preferably made from nylon and is shaped to fit into the top end of a drill-string 4.

The shaft 30, cylinder 15, bung 60 and cap 40 shown in FIG. 2 are arranged such that their longitudinal axes are coincident. At the end of the cylinder 15, beyond which the shaft 30 protrudes, there is mounted an end-cap 110. The end-cap 110 seals the inside of the cylinder 15 from the outside, whilst also allowing the shaft 30 to slide in or out of the cylinder 15. Seals, such as O ring seals 25 are used to seal between the end-cap 110 and shaft 30.

The connector 10 further comprises a piston 50. The piston 50 is slidably mounted on the shaft 30 inside the cylinder 15 and is free to move between the cap 40 and the end-cap 110. The whole assembly 20, 40, 50 and 60 is also able to slide in the cylinder 15. The inside of the cylinder 15 is divided by the piston 50 to form a first chamber 80 and a second chamber 70. The first and second chambers 80 and 70 preferably hold air and drilling-mud respectively. The piston 50 is sealed against the shaft 30 and cylinder 15, for example by means of O ring seals 52 and 54, to ensure no flow communication between the two chambers 70 and 80. The first chamber 80 is in flow communication with an air supply via a port 100 and the second chamber 70 is provided with drilling-mud via a socket 90. The top drive 2 is connected to the connector 10 via a conventional thread in the socket 90.

Figure 3:
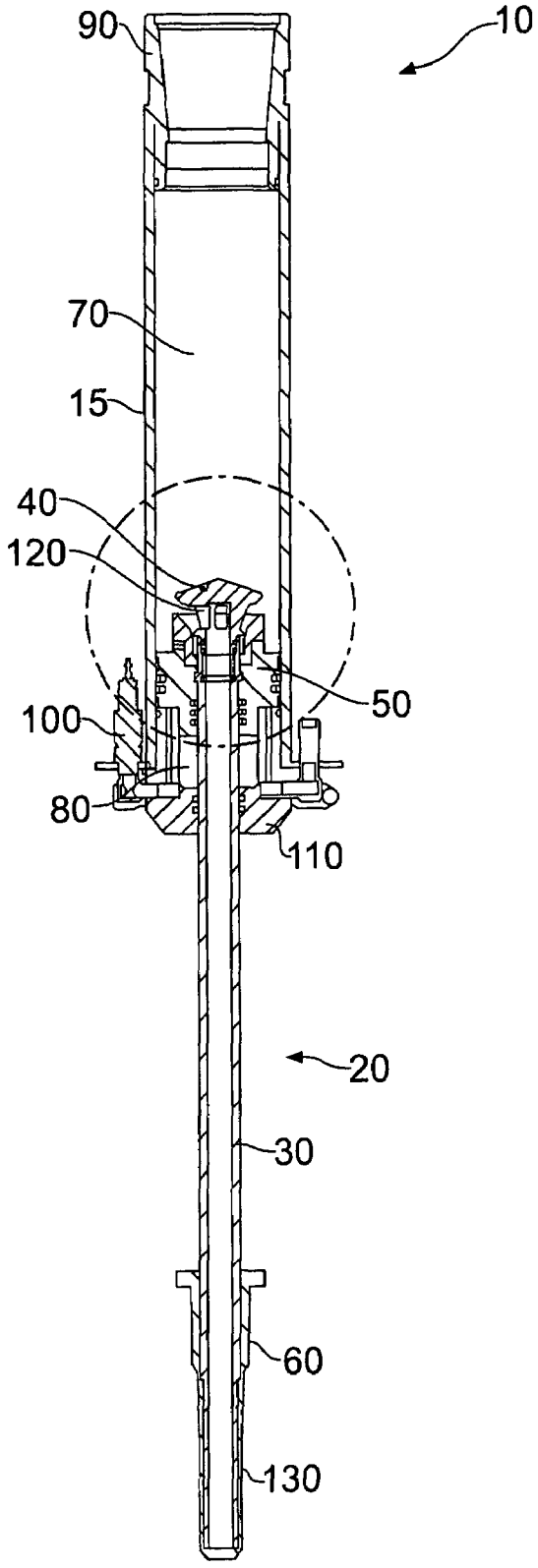
FIG. 3 is a sectional side projection of the connector and shows the connector when engaged with the drill-string.

In the disposition of components shown in FIG. 2, the piston 50 and cap 40 are touching, so that drilling-mud cannot flow from the second chamber 70 to the drill-string 4. FIG. 3, shown an alternative disposition of the cap 40 and piston 50. With the cap 40 and piston 50 apart, holes 120 are exposed in the side of the cap 40. These holes 120 provide a flow communication path between the second chamber 70 and the interior of the hollow shaft 30. Thus drilling-mud can flow from the second chamber 70 to the drill-string 4, via the holes 120 in the cap 40 and the hollow shaft 30.

Figure 4:
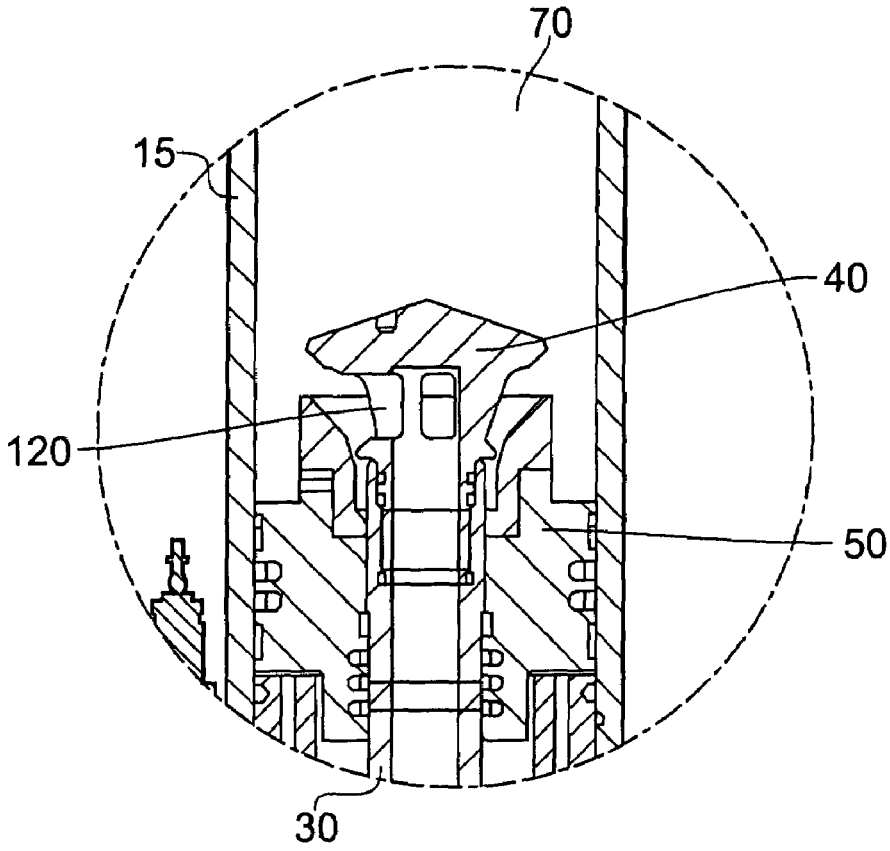
FIG. 4 is a more detailed sectional view of the connector and shows the connector in position to transfer drilling-mud to the drill-string.

FIG. 4 shows further detail of the structure of the cap 40 and piston 50. In particular, the flow communication path between the second chamber 70 and the hollow shaft 30, via the holes 120, is further highlighted.

In operation of the connector 10, the pressure of the air in the first chamber 80 is kept at a constant value of approximately 100 psi. By contrast, the pressure of the drilling-mud in the second chamber 70 is varied and it is this pressure that controls the operation of the connector 10.

When the pressure of the drilling-mud pressure is sufficiently low, so that (accounting for the differences in the projected areas of the two sides of the piston 50), the force exerted on the piston 50 by the drilling-mud is less than the force exerted on the piston 50 by the compressed air, the piston 50 is biased towards the cap 40 and socket 90. The piston 50 forces the retraction of the piston-rod 20 into the cylinder 15. The piston 50 also abuts the cap 40, thereby closing the holes 120 and ensuring no drilling-mud flows out of the connector 10. When the piston-rod 20 is retracted, the bung 60 and the seals 130 are disengaged from the drill-string 4 and the top most section of the drill-string 4 can be removed.

To extend the piston rod 20, so that the bung 60 and seal 130 engage the drill-string 4, the pressure of the drilling-mud is increased. Once this pressure exceeds a certain threshold, the force exerted by the drilling mud on the piston 50 exceeds the force exerted by the compressed air on the piston 50, so that the cap 40 is forced toward the end-cap 110 and the piston-rod 20 extends. As the projected area of the cap 40 is greater than the projected area of the piston 50 and the air pressure is only exposed to the piston 50, the piston 50 remains abutted to the cap 40. Thus, whilst the piston-rod 20 is extending, the holes 120 are not exposed and drilling-mud cannot flow.

Once the bung 60 and seals 130 are forced into the open threaded end of the drill-string 4, thereby forming a fluid tight seal between the piston-rod 20 and the open end of the drill string 4, the piston-rod 20, and hence cap 40, are no longer able to extend. By contrast, as the piston 50 is free to move on the shaft 30, the piston 50 is forced further along by the pressure of the drilling-mud. The holes 120 are thus exposed and drilling-mud is allowed to flow from the second chamber 70, through the piston-rod 20 and into the drill-string 4. The drill-string 4 can then be lifted by clamping the elevators 6 to the drill-string 4 and raising them.

As described above, the connector 10 replaces the traditional threaded connection between a top drive 2 and drill-string 4 during the removal of a drill-string 4 from a well. With this connector, the connection between the top drive 2 and drill-string 4 can therefore be established in a much shorter time and great savings can be achieved.

The invention claimed is:

1. A connector to provide a fluid tight connection between a fluid supply and a pipe, the connector comprising:

a cylinder;

a piston-rod comprising a seal towards a free end thereof that is adapted to sealingly engage the pipe; and a valve configured to permit flow from the fluid supply to the pipe only when the seal is engaged with the pipe;

wherein the valve is operable between a closed position and an open position by a pressure of a fluid from the fluid supply.

2. A connector as claimed in claim 1, wherein the seal between the connector and the pipe is provided by the location of a tapered bung in the open end of the pipe.

3. A connector as claimed in claim 1, wherein the piston-rod comprises a cap and a shaft which are joined together, the shaft being slidably mounted within the cylinder.

4. A connector as claimed in claim 3, wherein the cap and part of the shaft are located inside the cylinder.

5. A connector as claimed in claim 3, wherein the connector further comprises a piston, the piston being slidably mounted on the shaft within the cylinder.

6. A connector as claimed in claim 5, wherein the piston and cap divide the cylinder into first and second chambers.

7. A connector as claimed in claim 6, wherein the second chamber contains drilling-mud.

8. A connector as claimed in claim 6, wherein the first chamber contains compressed air.

9. A connector as claimed in claim 6, wherein the piston-rod provides a flow communication path between the second-chamber and the pipe.

10. A connector as claimed in claim 9, wherein the shaft is hollow.

11. A connector as claimed in claim 9, wherein the flow communication path from the second chamber into the pipe is blocked, until the piston rod has sealingly engaged the pipe.

12. A connector as claimed in claim 11, wherein the piston and cap act as the valve, such that if the pressure difference on opposite sides of the piston cause the piston to move away from the cap the flow communication path is unblocked.

13. A connector as claimed in claim 12, wherein, a hole is formed in the cap which is sealed by the piston when it engages the cap, the hole opening into the shaft, and together with the shaft comprising the flow communication path.

14. A connector as claimed in claim 1, wherein the pipe is a drill-string.

15. A connector as claimed in claim 1, wherein the seal engages an internal bore of the pipe.

16. A connector as claimed in claim 15, wherein the seal engages the internal bore of the pipe at a position beyond a connection portion of the pipe.

17. A connector as claimed in claim 1, wherein the piston-rod is selectively rotatable with respect to the cylinder.

18. A connector which provides a fluid tight connection between a fluid supply and a pipe, the connector comprising a piston-rod and a cylinder, the piston-rod comprising a seal at or towards its free end which is adapted to sealingly engage the pipe, and the piston-rod comprising a cap and a shaft which are joined together, the shaft being hollow and slidably mounted within the cylinder, the connector further comprising a piston, the piston being slidably mounted on the shaft within the cylinder, so that the piston and cap divide the cylinder into first and second chambers, the cap comprising a hole which opens into the shaft, the hole being (a) sealed by the piston when the piston engages the cap, and (b) exposed to the second chamber when the piston is not engaged with the cap, so that the piston-rod selectively provides a flow communication path between the second-chamber and the pipe;

wherein a projected area of the cap exposed to the second chamber and a projected area of the piston exposed to the second chamber are selected so that the pressure force acting on the cap exceeds the pressure force acting on the piston, the pressure of a fluid in the second chamber thereby acting to extend the piston-rod with the hole remaining sealed until the piston rod has sealingly engaged the pipe.

19. A connector as claimed in claim 18, wherein the pipe is a drill-string.

20. A connector as claimed in claim 18, wherein the projected area of the cap exposed to the second chamber is greater than the projected area of the piston exposed to the second chamber.

21. A connector as claimed in claim 18, wherein the hole is prevented from being exposed to the second chamber when the piston-rod is fully extended.

22. A method of using a connector to provide a fluid tight connection between a fluid supply and a pipe, wherein the connector comprises a cylinder, a piston-rod having a seal towards a free end thereof, and a valve configured to permit flow from the fluid supply to the pipe only when the seal is engaged with the pipe, wherein the valve is operable from a closed position to an open position by a pressure of fluid from the fluid supply, the method comprising:

controlling the pressure of the fluid from the fluid supply to (a) selectively sealingly engage the seal with the pipe; and (b) open the valve.

23. A connector to provide a fluid tight connection between a fluid supply and a pipe, the connector comprising:

a cylinder;

a piston-rod comprising a shaft, a cap attached to one end of the shaft, and a seal disposed at or towards the other end of the shaft, wherein the cap and at least a portion of the shaft are disposed within the cylinder, the shaft is slidably mounted within the cylinder, and the seal is adapted to sealingly engage the pipe; and a valve configured to permit flow from the fluid supply to the pipe only when the seal is engaged with the pipe;

wherein the valve is opened by a pressure of fluid from the fluid supply.

24. A connector to provide a fluid tight connection between a fluid supply and a pipe, the connector comprising:

a cylinder;

a piston-rod comprising a shaft, a cap attached to one end of the shaft, and a seal disposed at or towards the other end of the shaft, wherein the shaft is slidably mounted within the cylinder and the seal is adapted to sealingly engage the pipe; and a piston slidably mounted onto the shaft such that the piston and the cap form a first chamber and a second chamber within the cylinder;

wherein the piston-rod provides a flow communication path between the second chamber and the pipe;

wherein the piston and the cap are configured to permit flow from the fluid supply to the pipe only when the seal is engaged with the pipe;

wherein an opening is developed between the piston and the cap by a pressure of fluid from the fluid supply.

* * * * *